US006553572B2

(12) United States Patent
Fiorini et al.

(10) Patent No.: US 6,553,572 B2
(45) Date of Patent: Apr. 29, 2003

(54) REMOVABLE INSERT FOR ATHLETIC LEG GUARDS

(75) Inventors: Jeffrey L. Fiorini, Norcross, GA (US); Bram Krieger, Norcross, GA (US); Shingo Nemoto, Norcross, GA (US); Masao Nagai, Norcross, GA (US); Shigeki Kuroda, Osaka (JP)

(73) Assignee: Mizuno Corporation, Osaka (JP)

( * ) Notice: Subject to any disclaimer, the term of this patent is extended or adjusted under 35 U.S.C. 154(b) by 0 days.

(21) Appl. No.: 09/910,488

(22) Filed: Jul. 20, 2001

(65) Prior Publication Data

US 2003/0024029 A1 Feb. 6, 2003

(51) Int. Cl.[7] ..... A41D 13/00
(52) U.S. Cl. ..... 2/22; 2/911
(58) Field of Search ..... 2/22, 24, 16, 455, 2/23, 62, 69, 242, 44–46, 267, 911, 459, 463–467, DIG. 3; 128/846, 878, 881, 882; 602/5, 6, 23, 25, 26, 61, 62, 63; 36/1.5, 2 R; D2/901, 999; D29/120.1, 121.1

(56) References Cited

U.S. PATENT DOCUMENTS 967,004 A * 8/1910 Ehikian ..... 2/24
1,055,040 A * 3/1913 Herron et al. ..... 2/24
1,090,446 A * 3/1914 Boynton ..... 2/24
4,116,236 A 9/1978 Albert
4,287,885 A * 9/1981 Applegate ..... 2/24
4,561,123 A * 12/1985 Hull ..... 2/23
4,692,946 A 9/1987 Jurga
4,723,322 A 2/1988 Shelby
5,452,475 A 9/1995 Hunt
5,524,292 A * 6/1996 Hargens ..... 2/24
5,732,411 A * 3/1998 Coleman et al. ..... 2/22
5,987,643 A 11/1999 Beutler
6,178,555 B1 * 1/2001 Williams ..... 2/22
6,178,556 B1 1/2001 Foreman et al.
D451,644 S * 12/2001 Fujimoto et al. ..... D29/120.1

* cited by examiner

*Primary Examiner*—Gloria M. Hale
*Assistant Examiner*—Tejash Patel
(74) *Attorney, Agent, or Firm*—Gerald R. Boss; Wm. Brook Lafferty; Troutman Sanders LLP

(57) ABSTRACT

A protective leg guard having a removable insert for orienting the leg guard on a leg. The protective leg guard includes a protective knee portion having an inner surface generally contoured to substantially overlay the knee. A removable insert is adapted to fit between the knee portion of the leg guard and the knee when the leg guard is worn. The removable insert may be placed in a plurality positions on the inner surface of the knee portion and cooperates with the knee to maintain the leg guard in alignment on the front of the leg.

7 Claims, 5 Drawing Sheets

REMOVABLE INSERT FOR ATHLETIC LEG GUARDS

TECHNICAL FIELD

This invention relates in general to protective leg guards for athletes and more particularly to a removable insert adapted to be fitted between the knee and the inside of the leg guard for providing mounting stability at the leg guard to the athlete and for cushioning the knee.

BACKGROUND OF THE INVENTION

Padded leg guards such, as those utilized by baseball catchers are known in the athletic equipment industry. Typically, these known leg guards include multiple rigid portions of a hardened material configured to conform to the shape of an athlete's leg. The rigid portions are secured together in a manner to permit movement of the leg without obstructing the leg's range of motion.

The inside surface of these known leg guards are typically concave-shaped to conform to the anterior surface of the leg. The inside surface is also typically lined with a padding material for the comfort of the athlete as well as for extra protection. The padding material extends over the inner surface of each rigid portion in substantially a uniform manner. These known leg guards also include a plurality of straps for securing the leg guard to the athlete's leg. The straps extend from one side of the leg guard, extend around the back of the athlete's leg, and then are secured to the opposite side of the leg guard.

However, these known leg guards often become misaligned on the front of the athlete's leg, thereby leaving a portion of the front of the athlete's leg exposed. These known leg guards easily become misaligned during the constant movement of the catcher because the athlete's leg and the inner surface of the leg guard are rounded. This allows the leg guard to rotate to one side of the leg while wearing the leg guard. Also, the leg guard is allowed to rotate when the portion of the leg guard over the athlete's knee is not held closely against the knee. In such case, the gap between the knee and the leg guard is often created by the athlete's bending at the knees.

Some known knee braces have been adapted to include padding. For example, in U.S. Pat. No. 4,116, 236 to Albert, an elastic knee brace which includes a resilient pad disposed between the knee brace and the kneecap is disclosed. The resilient pad overlays the kneecap and variably positions itself with the kneecap when the opening in the knee brace is misaligned with the kneecap. Albert concentrates on maintaining padding around the knee to maintain the localization of pressure and protection of the injured knee even when the brace is misaligned. The resilient pad is mounted within a pocket of the sleeve and permitted to float and align itself with the knee when the knee brace is not properly aligned with the kneecap. Consequently, Albert's pad does not facilitate the proper alignment of the knee brace with the kneecap while the knee brace is being worn.

Accordingly, there is a need for a leg guard capable of continuously protecting the athlete's leg by maintaining the leg guard in proper alignment against the anterior portion of the athlete's leg without compromising the athlete's mobility and flexibility.

SUMMARY OF THE INVENTION

The present invention solves the above-identified problems by providing a removable insert adapted to overlay the athlete's knee. The removable insert cooperates with the knee to continuously orient the leg guard in the proper position on the front of the athlete's leg.

Generally described, the protective leg guard of the present invention includes a rigid knee portion having an inner surface generally contoured to substantially overlay the knee. A removable insert is adapted to fit between the knee portion and the knee when the leg guard is worn. The removable insert is further adapted to be placed in a multitude of positions on the inner surface of the knee portion to substantially overlay the knee. The removable insert cooperates with the knee to maintain the leg guard in alignment on the leg.

The foregoing has broadly outlined some of the more pertinent aspects and features of the present invention. These should be construed to be merely illustrative of some of the more prominent features and applications of the invention. Other beneficial results can be obtained by applying the disclosed information in a different manner or by modifying the disclosed embodiments. Accordingly, other aspects and a more comprehensive understanding of the invention may be obtained by referring to the detailed description of the exemplary embodiments taken in conjunction with the accompanying drawings, in addition to the scope of the invention defined by the claims.

BRIEF DESCRIPTION OF THE DRAWINGS

Similar reference characters refer to similar parts throughout the several views of the drawings.

DESCRIPTION OF A PREFERRED EMBODIMENT

Figure 1:
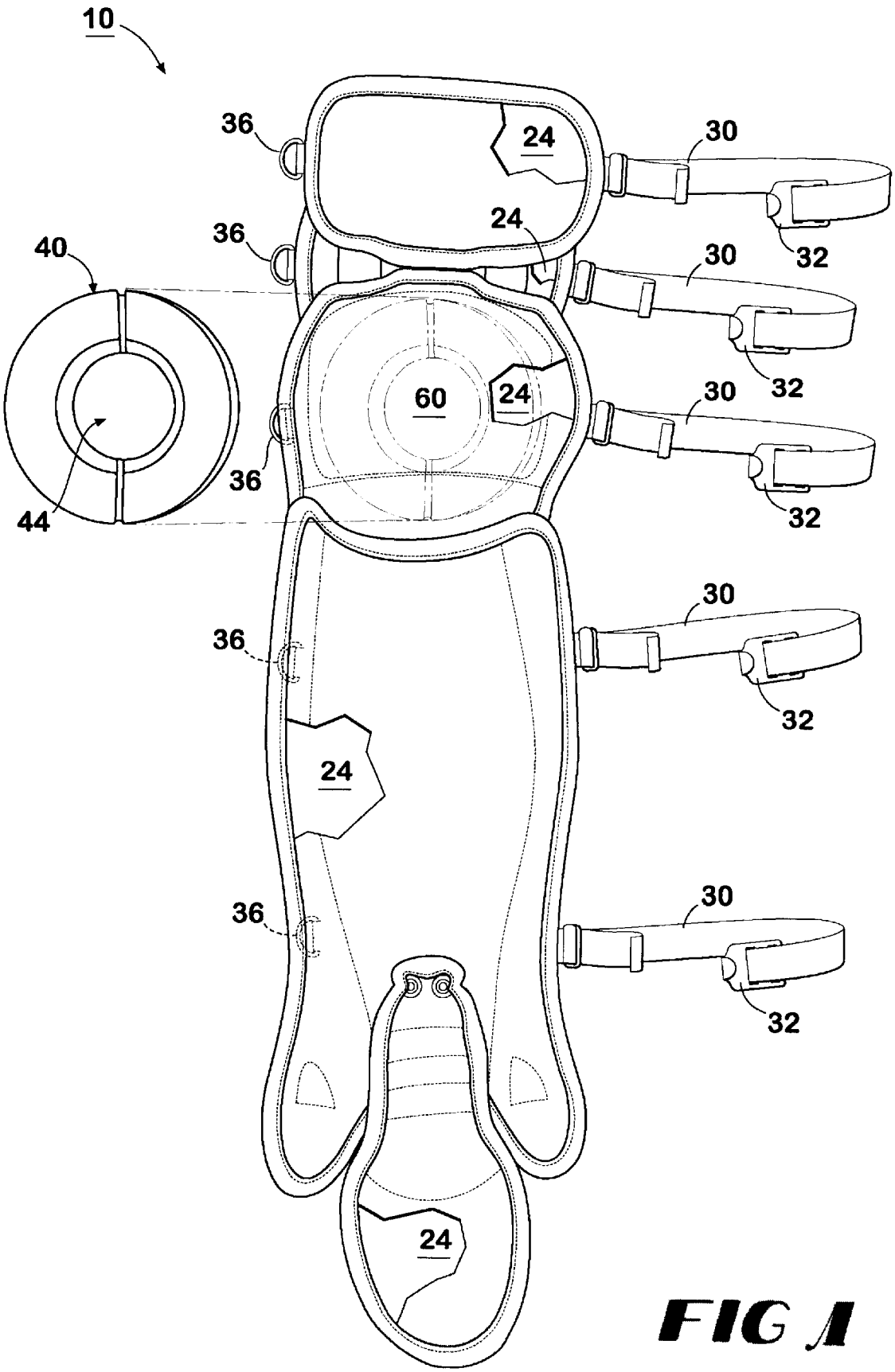
FIG. 1 is a partially exploded, perspective view of one embodiment of the back of a leg guard according to the present invention.

Referring now to the drawings in which like numerals indicate like elements throughout the several views, FIG. 1 illustrates an exemplary embodiment of a leg guard 10 of the present invention. The leg guard 10 may be a baseball catcher's leg guard, a goalie's leg guard, a leg guard for some other type of athletic event, or for other activities requiring protection of the leg including the thigh, knee, shin, ankle and/or foot. However, the leg guard 10 shown in FIGS. 1–3 illustrates the present invention in the form of a baseball catcher's leg guard.

Figure 2:
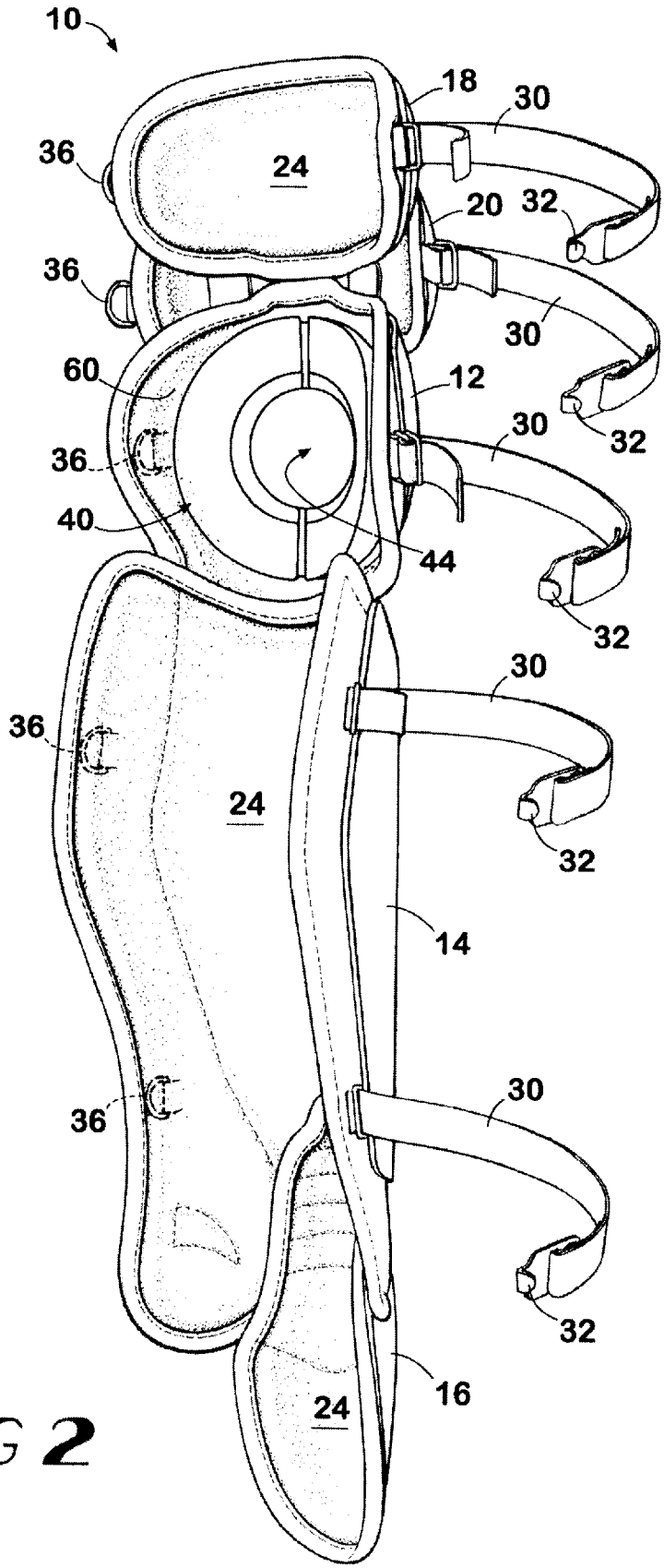
FIG. 2 is another perspective view of the leg guard of FIG. 1 rotated to partially illustrate one embodiment of the front of the leg guard.
Figure 3:
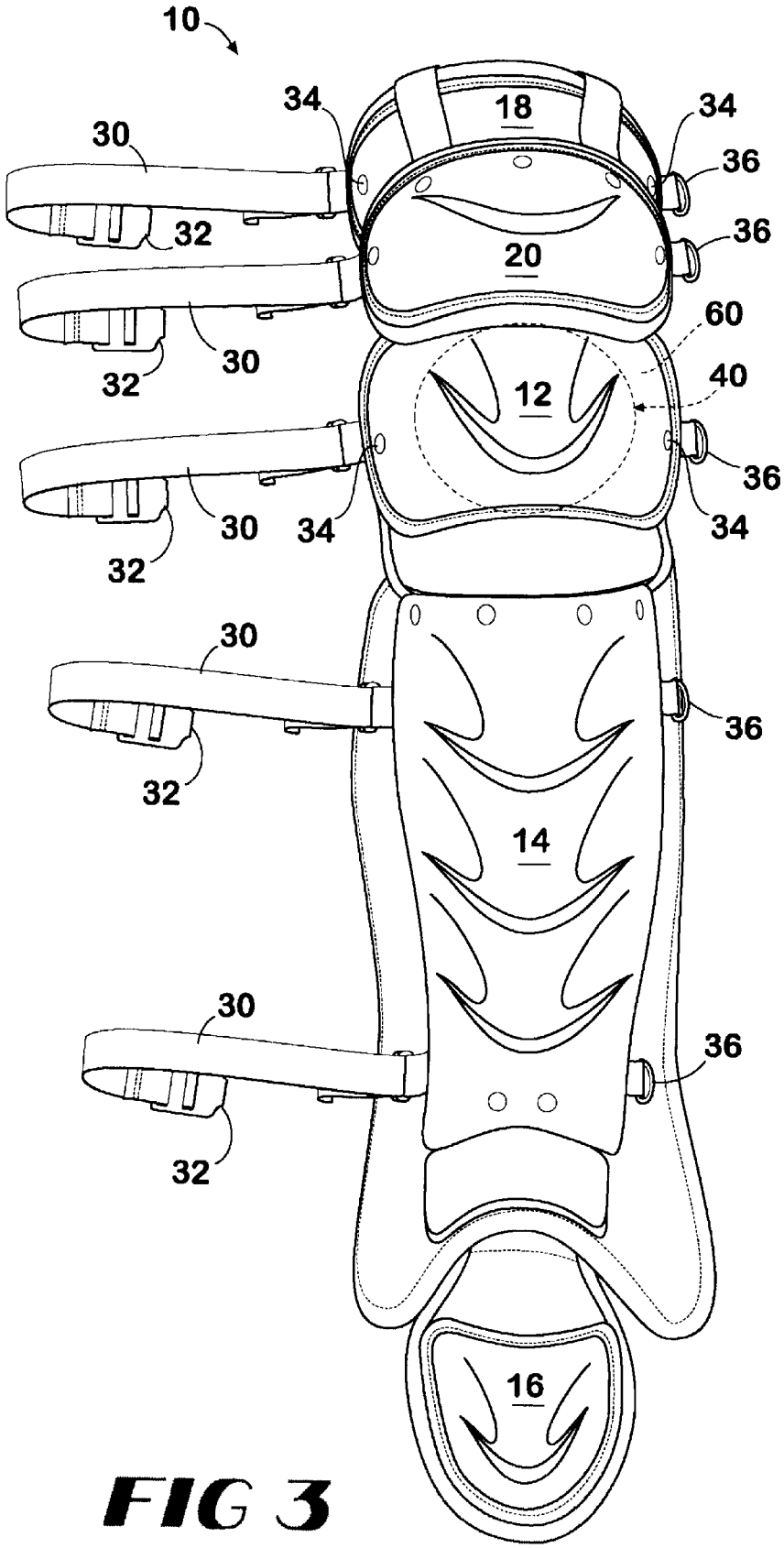
FIG. 3 is a front view of one embodiment of the leg guard of the present invention illustrating in particular the orientation of a removable insert on the leg guard according to the present invention.

As best shown in FIGS. 1–3, the leg guard 10 includes a rigid outer knee portion 12, a rigid and elongated outer shin portion 14, a rigid outer ankle and foot portion 16, a first rigid outer thigh portion 18 and a second rigid outer thigh portion 20 for overlying the leg. Other embodiments of the leg guard 10 of the present invention may include only the knee and shin portions 12 and 14 of the leg guard 10. The knee portion 12, shin portion 14, ankle and foot portion 16, and thigh portions 18 and 20 are molded from polyethylene or any other hard material suitable for providing protection from impacts to the leg.

The knee portion 12, shin portion 14, ankle portion 16, and thigh portions 18 and 20 each have a padded backing 24 extending substantially over the entire back surface of each of the rigid portions 12, 14, 16, 18, and 20. The rigid portions are attached to one another with fasteners, straps or by any other means suitable for attaching the portions together without compromising the user's flexibility or mobility. The rigid portions 12, 14, 16, 18, 20 and padded backing 24 cooperate together to conform the leg guard 10 to the athlete's leg. The padded backing 24 may be a soft dense foam known in the industry or any other material suitable for providing additional protection between each of the rigid portions 12, 14, 16,. 18 and 20 of the leg guard 10 and the leg while also allowing some degree of comfort for the athlete while wearing the leg guard 10.

The leg guard 10 may include a plurality of elongated flexible members such as straps 30 with hook fasteners 32 for fastening the leg guard 10 to the leg by extending from rivets 34 on one side of the leg guard 10, around the back of the leg, and hooking with the hook fasteners 32 to D-rings 36 or other suitable loop fasteners. Preferably, the straps 30 are adjustable to accommodate different sizes of legs.

Still referring to FIGS. 1–3, the present invention includes a knee receptacle 40 sized to fit between the knee portion 12 of the leg guard 10 and the knee while the leg guard 10 is worn. Knee receptacle may be an integral component of leg guard 10, or it may be an independent insert. The knee receptacle is preferably made of the same material as the padded backing 24 described above. However, other cushioning materials may be substituted which are capable of filling a space, giving shape, and to protect against injury. The knee receptacle 40 is preferably annular or unshaped, but may be shaped in an alternative manner suitable for overlaying the knee.

Figure 4:
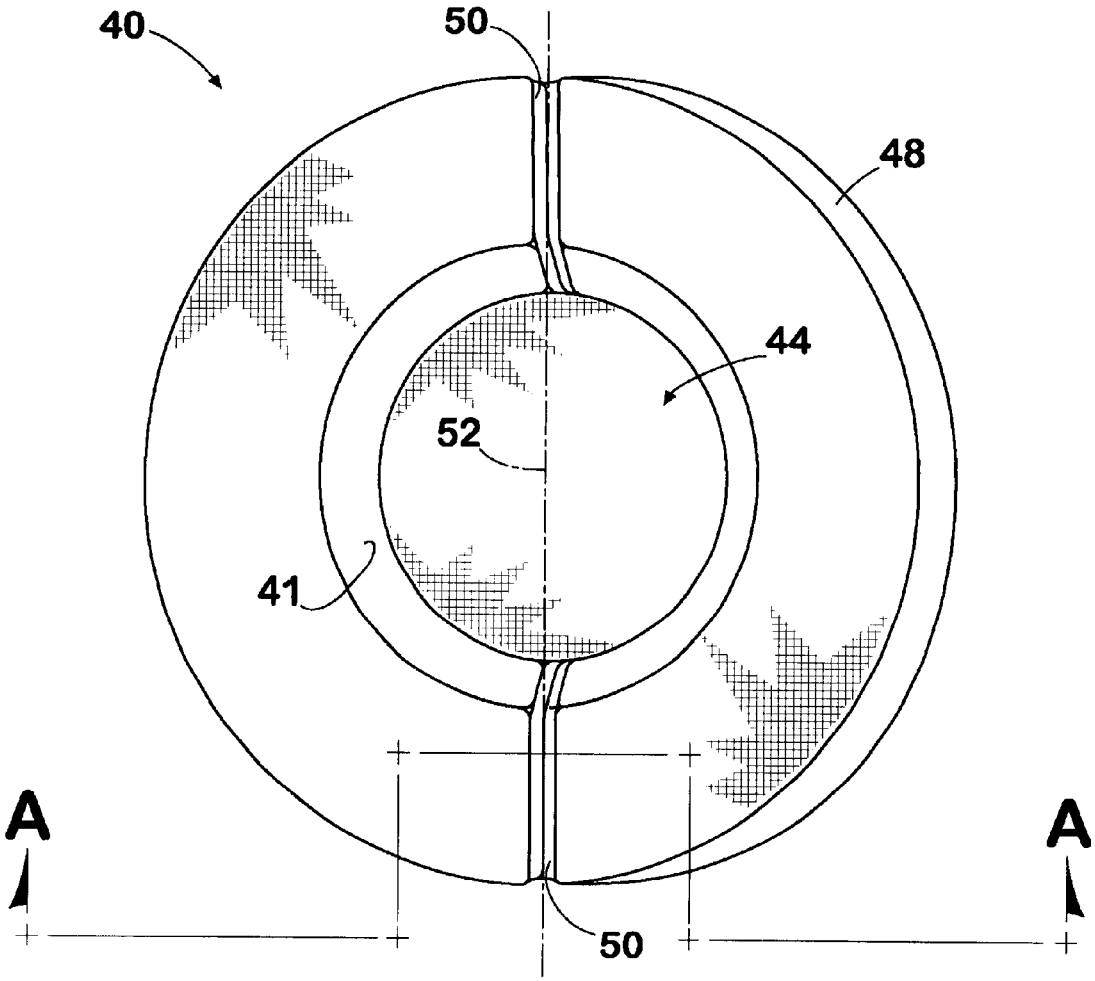
FIG. 4 is a perspective view of one embodiment of the removable insert according to the present invention.

FIG. 4 illustrates one embodiment of the insert 40 of the present invention. The insert 40 is annular having side walls 41 of a predetermined height defining a central cavity 44 for receiving the knee. A pair of opposing cut-out portions 50 extends through the outer edge portion 48 of the insert 40 and into the central cavity 44. The cut-out portions 50 preferably having a length greater than a width and are aligned lengthwise with one another to partially define fold line 52 extending the full height of the insert 40. When the insert 40 is placed over the knee, the fold line 52 allows the insert 40 to fold somewhat to allow the insert 40 to more completely overlay and conform to the knee.

Figure 5:
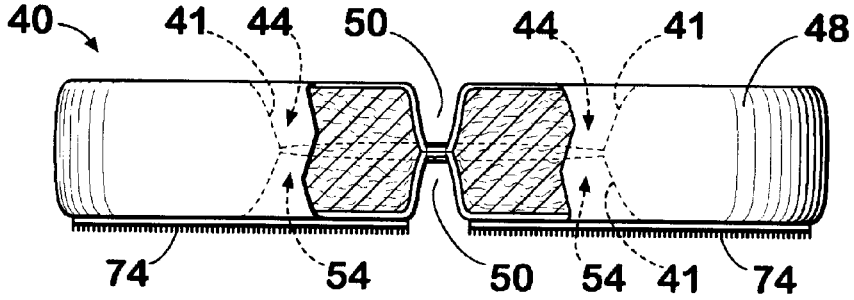
FIG. 5 is a side view of the removable insert of FIG. 4 taken along line A—A.

As best shown in FIG. 5, the insert 40 may also include a second central cavity 54 disposed on the back side opposite the first central cavity. A second pair of cut-out portions 56 may also be included to oppose cut-out portions 50 so that the front and back of the insert are mirror images enabling a catcher to quickly place the insert in position. Preferably, the insert 40 is made up of multiple layers of padding. For example, the cavity 44 may be one layer of padding and the outer edge portion 48 may be made up of at least two portions of padding over the top of each other to provide the greater thickness when compared to the padding of cavity 44. In this case, the insert 40 is three layers of padding. The padding of the cavity 44 is preferably thinner than any single layer of the outer edge portion 48.

Referring back to FIGS. 1–3, the insert 40 is sized to remain on an inner surface 60 within the confines of the knee portion 12. When the leg guard 10 is worn, a gap or void may form between the knee portion 12 and the knee. The insert 40 may assume any number of positions within the knee portion 12 to fill this gap. Because the insert 40 overlays the knee and fills any void created between the knee and the knee portion 12 of the leg guard, the insert 40 is continuously urged by the knee against the inner surface 60 of the knee portion 12 which results in the leg guard 10 maintaining the proper alignment on the front anterior portion of the leg while the leg guard is worn.

The removable inserts 40, 70 are preferably detachably secured to the inner surface 60 of the knee portion 12 of the leg guard 10. When the removable inserts are secured to the leg guard, they function as an extension of the leg guard which receives the catcher's knee. When the knee is received within the central cavity of the insert, preferably no clearance exists between the knee and the side walls. Thus with the insert fixed in position with the leg guard, the leg guard is anchored with respect to the catcher's knee preventing the leg guard from twisting out of position to allow variable positioning in the knee portion 12 by removing the insert from one position and then reattaching the insert in another position on the inner surface 60. To detachably secure either of the inserts 40, 70 to the inner surface 60, hook and loop fasteners 74 may be utilized as shown in FIG. 5. The hook and loop fasteners 74 may be attached along the outer edge portion 48 on one side of the insert 70. Alternatively, the second central cavity 54 on the back of insert 40 may be shallower than the first central cavity 44 on the front of the insert so that hook and loop fasteners 74 may be attached to the back of the insert 40 to engage the inner surface 60. Preferably, the padding 24 on the inner surface 60 is suitable for securing the inserts 40, 70 with the hook and loop fasteners 74.

Alternatively, each one of the inserts 40, 70 may be positioned between the knee and the knee portion 12 while the leg guard 10 is worn such that the combination of the catcher's knee and the elastic urging of the leg straps maintain the inserts in place through compressive forces. Consequently, the inserts 40, 70 are free of any means for fixed attachment to the inner surface 60 of the knee portion 12, but the leg guard 10 is maintained in the desired position on the front anterior portion of the leg because the inserts are immobile and anchored with respect to the catcher's knees.

Figure 6:
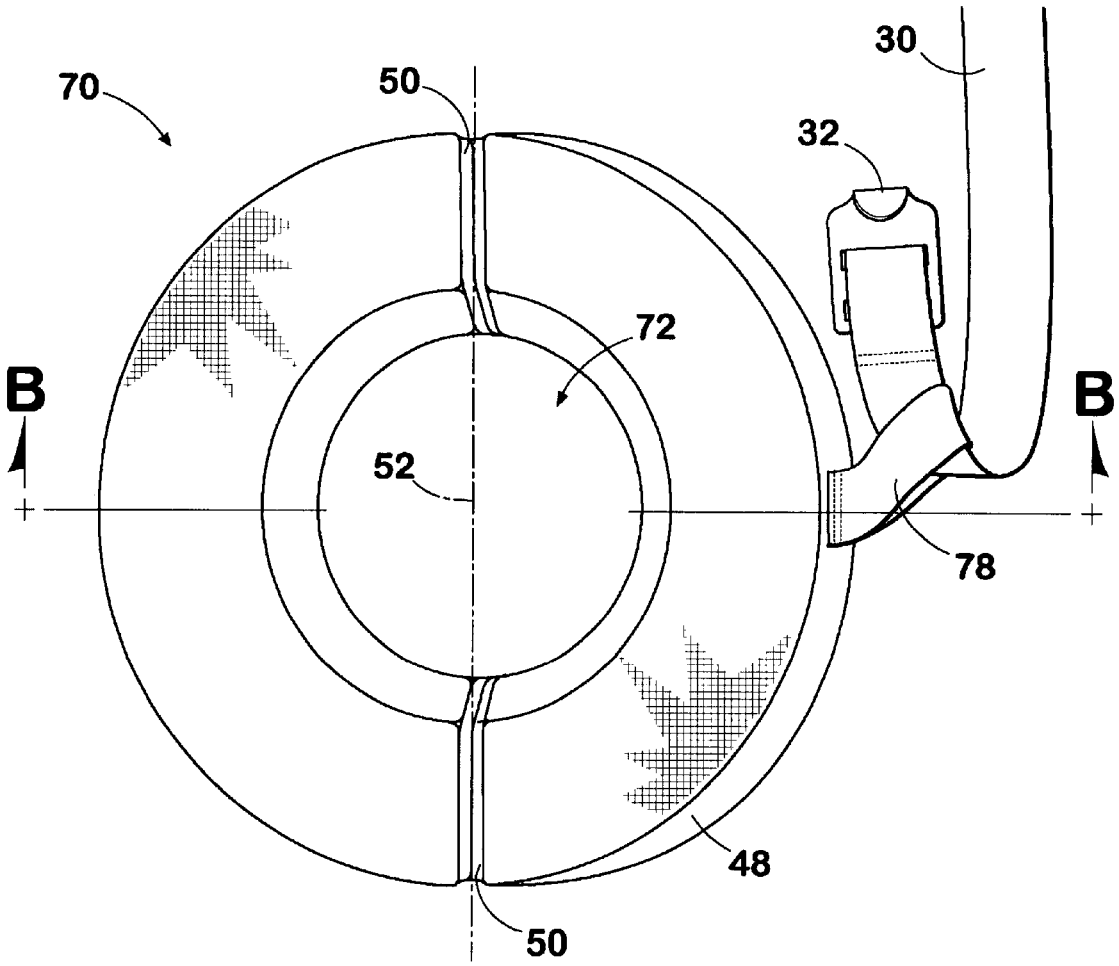
FIG. 6 is a perspective view of an alternative embodiment of a removable insert according to the present invention.

To allow the inserts 40, 70 to free-float, an elongated flexible member such as a strap 78 secures the inserts 40, 70 to the leg guard 10. In FIG. 6, the insert 70 includes a strap 78 looped back over itself to form a loop for receiving one of the straps 30 used for securing the leg guard 10 to the leg. The looped strap 78 allows the insert 70 to move up and down along the length of one of the straps 30 when the insert 70 is not between the knee and the knee portion 12 of the leg guard 10. The length of the strap 78 is preferably long enough to define a loop sufficient to extend out from between the leg guard 10 and the leg.

Figure 7:
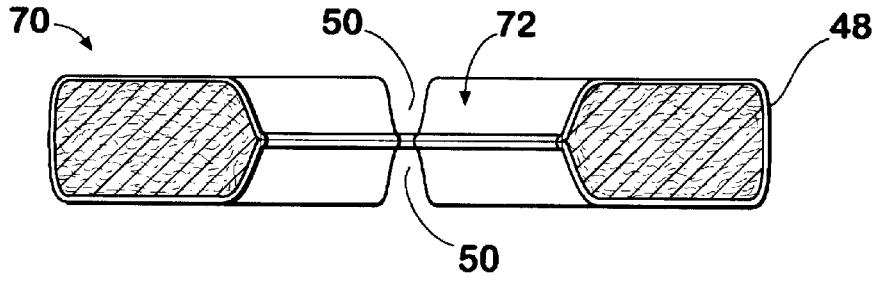
FIG. 7 is a side view of the removable insert of FIG. 6 taken along line B—B.

Although the use of the inserts 40, 70 described above constitute an inventive leg guard 10 as described above, the combination of inserts 40, 70 as described above also constitute an inventive kit of inserts for use with leg guards. In one embodiment, the kit of inserts includes the insert 40 together with the insert 70 as described above. Either of the inserts 40, 70 may optionally include hook and loop fasteners 74 for detachably securing the inserts 40, 70 to the inner surface 60 of the knee portion 12 of the leg guard 10 or the strap 78 for allowing the inserts 40, 70 to free-float as described above. FIG. 6 illustrates an alternative embodiment of a removable insert 70 for overlaying the knee. The insert 70 also includes the outer edge portion 48. However, the outer edge portion 48 of the insert 70 defines an opening 72 through the insert 70 for receiving the knee. The insert 70 is also foldable at fold line 52. FIG. 7 best illustrates cut-out portions 50 and 56 in the insert 70 which partially define fold line 52.

The present invention has been illustrated in relation to particular embodiments which are intended in all respects to be illustrative rather than restrictive. Those skilled in the art will recognize that the present invention is capable of many modifications and variations without departing from the scope of the invention. Accordingly, the scope of the present invention is described by the claims appended hereto and supported by the foregoing.

What is claimed is:

1. A protective leg guard for protecting the front of the leg, comprising:

a knee portion having an inner surface generally contoured to substantially overlay the knee; and a knee receptacle having a central cavity and sidewalls which receives and encircle the knee of a person to maintain the leg guard in alignment with the front of the leg when detachably fixed on a plurality of contacts to the inner surface of said knee portion and the leg guard is worn on the leg.

2. An insert for a leg guard, the leg guard for protection of the front anterior portion of the leg, said insert comprising a padded member having opposite sides, one of said sides generally contoured to substantially overlay the knee of the leg, the other of said sides being detachably fixed on a plurality of contacts on the leg guard to variably position said insert in the leg guard, and said insert when detachably fixed in said leg guard cooperating with the knee to maintain the leg guard in alignment with the front anterior portion of the leg when the leg guard is worn.

3. The insert of claim 2 wherein said plurality of contacts comprises hook and loop fasteners for detachably fixing said insert to the leg guard.

4. An insert for use with a leg guard, said insert being detachably inserted on a plurality of contacts between the leg guard and the knee when the leg guard is worn, said insert comprising an elongated flexible member for securing said insert to the leg guard, said elongated flexible member carried by said insert and configured to extend out from between the leg guard and the leg when the leg guard is worn.

5. The insert of claim 4 wherein said elongated flexible member is adapted to be carried by another elongated flexible member extending from the leg guard for securing the leg guard to the leg.

6. The insert of claim 4 wherein said insert is free of means for fixed attachment of said insert to an inner portion of the leg guard.

7. A kit of inserts for a leg guard, each of said inserts adapted to be separately carried in a portion of a leg guard corresponding with the knee, at least one of said inserts for cooperating with the knee to maintain the leg guard in alignment with the front anterior portion of the leg, said kit of inserts comprising:

a first insert having a surface generally contoured to substantially overlay the knee; and a second insert having a cavity therethrough and generally contoured to substantially overlay the knee, each of said first and second inserts optionally comprising:

fastening means for detachably fixing said insert having said fastening means in a plurality of positions on the leg guard; or an elongated flexible member configured to extend out from between the leg guard and the leg when the leg guard is worn on the leg.

* * * * *